US007858891B2

(12) United States Patent
Strohband et al.

(10) Patent No.: US 7,858,891 B2
(45) Date of Patent: Dec. 28, 2010

(54) SHAPE-CHANGING CONTROL PANEL BUTTON BASED ON ACTIVATION/DEACTIVATION

(75) Inventors: Sven Strohband, Menlo Park, CA (US); Arne Stoschek, Palo Alto, CA (US); Michael Derse, New Haven, CT (US); Philippe Alessandrini, Montreal (CA); Venkat Srinivasan, San Francisco, CA (US)

(73) Assignee: Volkswagen Group of America, Inc., Herndon, VA (US)

( * ) Notice: Subject to any disclaimer, the term of this patent is extended or adjusted under 35 U.S.C. 154(b) by 559 days.

(21) Appl. No.: 11/409,686

(22) Filed: Apr. 24, 2006

(65) Prior Publication Data

US 2007/0247420 A1 Oct. 25, 2007

(51) Int. Cl.
*H01H 15/18* (2006.01)

(52) U.S. Cl. ..... 200/406

(58) Field of Classification Search ..... 200/406; 337/3, 16, 27, 36, 66, 85, 333
See application file for complete search history.

(56) References Cited

U.S. PATENT DOCUMENTS

| | | | | |
|---|---|---|---|---|
| 5,138,779 | A | 8/1992 | Earnest | |
| 5,166,832 | A | 11/1992 | Zychowicz | |
| 5,438,309 | A | 8/1995 | Krumme | |
| 5,829,253 | A | 11/1998 | Long et al. | |
| 5,909,804 | A * | 6/1999 | Kuratani | 200/516 |
| 6,240,347 | B1 * | 5/2001 | Everhart et al. | 701/36 |
| 2004/0004531 | A1 * | 1/2004 | Davis et al. | 337/53 |
| 2006/0036335 | A1 * | 2/2006 | Banter et al. | 700/17 |
| 2006/0109075 | A1 * | 5/2006 | Cabal et al. | 337/333 |

FOREIGN PATENT DOCUMENTS

| | | | |
|---|---|---|---|
| CA | 2 521 721 | A1 | 10/2004 |
| WO | WO 03/092426 | A1 | 11/2003 |
| WO | WO 2004/090042 | A1 | 10/2004 |

OTHER PUBLICATIONS

Andreas Lenlein, "Shape Memory Polymers—Biodegradable Sutures," available at http://www.azom.com/details.asp?ArticleID=1542, accessed on Dec. 21, 2005.
Website of Composite Technology Development, Inc., "Elastic Memory Composite (EMC) Material," available at http://www.ctd-materials.com/products/emc.htm, accessed on Dec. 21, 2005.
Steven Ashley, Artificial Muscles, Scientific American Magazine, Oct. 2003, pp. 53-59.

* cited by examiner

*Primary Examiner*—James Harvey
*Assistant Examiner*—Vanessa Girardi
(74) *Attorney, Agent, or Firm*—Manfred Beck, P.A.

(57) ABSTRACT

A button configuration includes a shape-changing button that has a central region and a peripheral region. The peripheral region encircles the central region and defines a surface plane. The shape-changing button has an active state and an inactive state. The central region of the button protrudes from the surface plane and provides a push button function when the button is in the active state. The central region of the button extends substantially in the surface plane and provides no push button function when the button is in the inactive state. A control panel having shape-changing buttons is also provided.

18 Claims, 5 Drawing Sheets

SHAPE-CHANGING CONTROL PANEL BUTTON BASED ON ACTIVATION/DEACTIVATION

BACKGROUND OF THE INVENTION

Field of the Invention

The invention relates to a reconfigurable, shape-changing button for a vehicle and to a vehicle control panel having reconfigurable, shape-changing buttons.

Modern cars have an ever-increasing number of convenience features such as audio systems, navigations systems, telecommunications equipment, climate control systems, power-operated seats, windows and mirrors. The increasing number of features of a car that can be controlled by vehicle occupants has generally resulted in an increased number of buttons, switches and other control elements on the dashboard, on the center console and on door interior consoles. A disadvantage of such complex control panels is that users are often overwhelmed by the large number of buttons and, as a consequence, users have problems finding the buttons or switches that they are looking for. A further disadvantage of conventional buttons, which are usually rigid protrusions on a surface of the vehicle interior, is that not all functions operated by these buttons tend to be used simultaneously by the user. Thus, more information is thrust on to the user than needed. Another disadvantage of conventional buttons is that non-functional buttons or so-called blank buttons are often present as a pre-installed feature in lower end models for future applications.

There have been efforts to mitigate the problems associated with a large number of buttons, switches and control elements in a car. One solution is a touch screen in the dashboard or front console of the vehicle. A user generally selects a desired function by looking for the function in a menu tree on the touch screen. A disadvantage of touch screens using a menu tree is that users may easily get lost in a complicated maze of menus. A touch screen reduces the number of buttons but generally does not simplify the operation of the vehicle. A further disadvantage of touch screens is that they do not have the tactile feel associated with pressing a button which is important both at a feature perception level as well as acting as an inherent feedback mechanism for the user.

SUMMARY OF THE INVENTION

It is accordingly an object of the invention to provide a button configuration and a vehicle control panel configuration which overcome the above-mentioned disadvantages of the heretofore-known button configurations and vehicle control panels of this general type and which overcome problems associated with control panels having a large number of buttons and in particular reduce costs, save space and are more user friendly and less confusing.

With the foregoing and other objects in view there is provided, in accordance with the invention, a button configuration including:

a button having a central region and a peripheral region, the peripheral region encircling the central region and defining a surface plane;

the button having an active state and an inactive state;

the central region of the button protruding from the surface plane and providing a push button function when the button is in the active state; and the central region of the button extending substantially in the surface plane and providing no push button function when the button is in the inactive state.

By providing a reconfigurable shape-changing button that can be active or inactive, it is possible to present to the user only those buttons that the user needs. This reduces the complexity of conventional button consoles and increases user friendliness. The button configuration according to the invention makes it possible to provide buttons on demand rather than providing buttons by default.

According to another feature of the invention, at least the central portion of the button includes a shape memory material. The shape memory material exhibits a bistability such that it forms a protrusion on the surface plane when the button is in the active state; and the shape memory material forms a substantially flat layer extending in the surface plane when the button is in the inactive state.

According to yet another feature of the invention, the shape memory material is a shape memory polymer and/or a shape memory alloy.

According to a further feature of the invention, a continuous layer of a shape memory polymer forms the central region and the peripheral region of the button. Using a continuous layer simplifies the manufacturing process and reduces cost.

In accordance with another feature of the invention, the shape memory material is a shape memory alloy wire mesh; and the shape memory alloy wire mesh is embedded in a flexible material. A NiTi alloy may be used as a shape memory alloy.

In accordance with yet another feature of the invention, the shape memory alloy wire mesh has an ohmic resistance and is configured to be heated with an electric current flowing through the shape memory alloy wire mesh; and the shape memory alloy wire mesh has a memory shape and deforms into the memory shape when heated to a given transformation temperature. An advantage of this embodiment is that no additional heating device is needed for heating the shape memory alloy.

According to a further feature of the invention, the shape memory material is a shape memory alloy thin film; and a flexible material and the shape memory alloy thin film form a sandwich structure. For example, the shape memory alloy thin film may be embedded in the flexible material or may be attached to the flexible material.

In accordance with another feature of the invention, the shape memory material is a shape memory polymer having a memory shape and the shape memory polymer deforms into the memory shape when heated to a given transformation temperature.

According to a further feature of the invention, an internal heating mechanism is integrated with the shape memory polymer. For example, an ohmic resistance may be used to generate heat.

In accordance yet a further feature of the invention, at least the central region of the button includes a compliant mechanism having two stable states such that the central region of the button forms a protrusion on the surface plane defined by the peripheral region when the button is in the active state and the central region of the button is substantially flat and level with the peripheral region of the button when the button is in the inactive state. The protrusion preferably has a hemispherical or dome-shaped surface. Typically, the compliant mechanism includes single-piece flexible structures wherein the structure can deform in three dimensions and transmit force or deliver motion due to an input actuation. An advantage of a compliant mechanism is that there are no joints and as a result no assembly is required which in turn reduces cost. A further advantage of a compliant mechanism without joints is that there is no wear and no backlash.

With the objects of the invention in view there is also provided, a vehicle control panel configuration, including:

a control panel including a button;

the button having a central region and a peripheral region, the peripheral region encircling the central region and defining a surface plane;

the button having an active state and an inactive state;

the central region of the button protruding from the surface plane and providing a push button function when the button is in the active state; and the central region of the button extending substantially in the surface plane and providing no push button function when the button is in the inactive state. An advantage of such a control panel is that the reconfigurable, shape-changing button functions and feels like a traditional button when it is in the active state and the button seems to disappear when it is in the inactive state.

According to another feature of the invention, the control panel is provided on a vehicle interior component such as a vehicle console, a door panel, a steering wheel or a dashboard.

According to yet another feature of the invention, a control unit is operatively connected to the button for selectively activating and deactivating the button.

In accordance with a further feature of the invention, the control panel includes further buttons operatively connected to the control unit; and the control unit selectively activates and deactivates the buttons for controlling an electronic vehicle subsystem. For example, the control unit could activate those buttons that are used for controlling the stereo system when the vehicle occupant wants to adjust the settings of the stereo system.

According to another feature of the invention, the buttons are configured to control an electronic vehicle subsystem such as an audio system, a navigation system, a climate control system and a communications system.

According to a further feature of the invention, the control unit is configured to activate the button via a voice control.

According to yet another feature of the invention, the control panel includes further buttons having an active state and an inactive state; and the control panel is configured to operate in a plurality of operating modes wherein a respective subset of the buttons is activated when the control panel is in a respective one of the operating modes; and a selection device is connected to the control unit for selecting the operating modes. The selection device may for example be a central scroll wheel close to or on the steering wheel which would allow scrolling through the various modes for the button console. The operating modes may for example include (a) all buttons off, (b) audio control buttons on, (c) radio, music and/or video control buttons on, (d) navigation buttons on, (e) car climate control buttons on, (e) buttons for driver assistance (e.g. cruise control) on, (f) infotainment buttons on, and (h) all buttons on.

In accordance with yet another feature of the invention, a display is disposed adjacent to the button; and the display indicates a function of the button when the button is in the active state.

Other features which are considered as characteristic for the invention are set forth in the appended claims.

Although the invention is illustrated and described herein as embodied in a reconfigurable, shape-changing button for a vehicle and a vehicle control panel having reconfigurable, shape-changing buttons, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
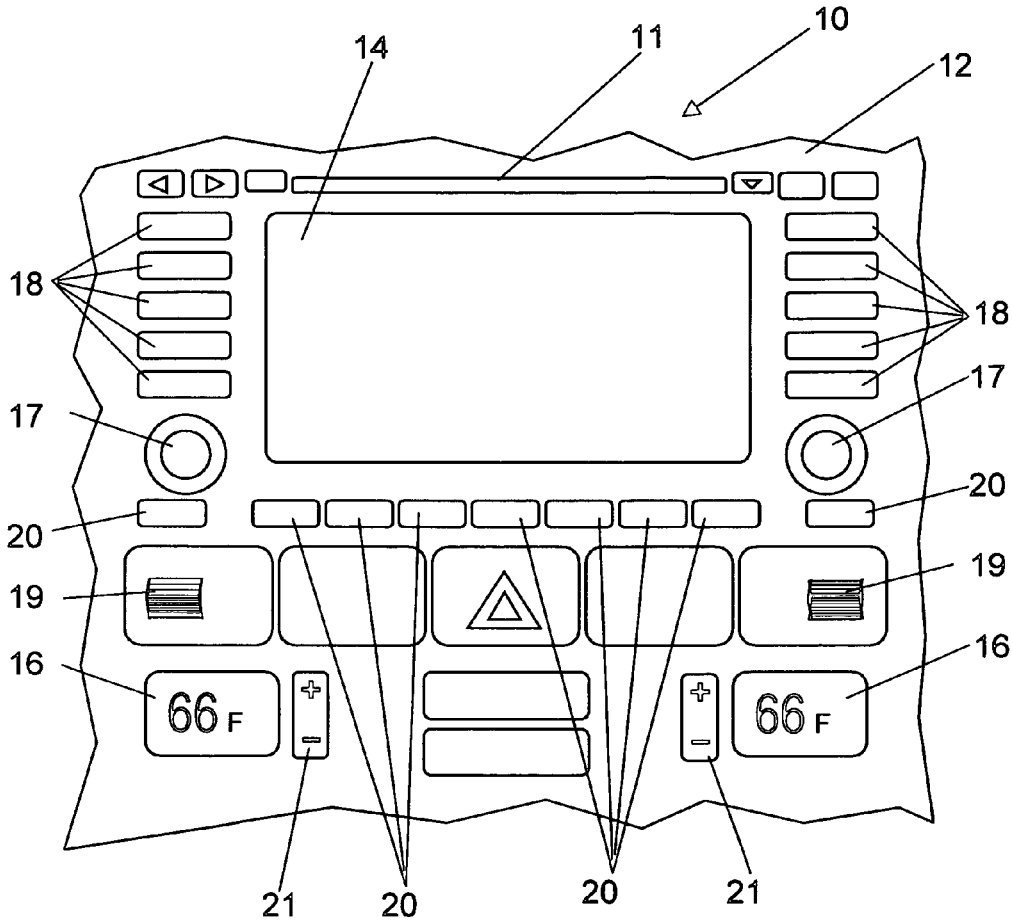
Prior Art FIG. 1
FIG. 1 is a diagrammatic plan view of a conventional vehicle console.

Referring now to the figures of the drawings in detail and first, particularly, to FIG. 1 thereof, there is shown a vehicle console 10 with a conventional console interface 12. The vehicle console 10 includes push buttons, rotary knobs, wheels and rocker switches for controlling various functions. The vehicle console 10 is used to control the stereo system, the climate control system, the navigation system and, depending on the specific vehicle, further vehicle systems.

The conventional console interface 12 shown in FIG. 1 includes a large center display 14 and two smaller liquid crystal displays 16. Selection buttons 18 are provided adjacent to the center display 14 along the left side and along the right side of the center display 14. Further selection buttons 20 are provided adjacent to the center display 14 along the bottom of the center display 14. The selection buttons 18, 20 are rigid, permanently installed selection buttons.

Above the center display 14 is a slot 11 that receives disks for audio, video or other digital data. Push buttons on either side of the slot 11 are used to control the disk operation. On either side of the center display 14 are rotary knobs 17 that may be used in a traditional manner for adjusting a radio receiver but may also be used to adjust further functions of the vehicle.

Rotary wheels 19 are provided for adjusting the temperature of a seat heating system. Below the rotary wheels 19 are liquid crystal displays 16 that indicate a temperature for the climate control system. Next to the liquid crystal displays 16 are rocker switches 21 that may be used to adjust a speed of a fan for the climate control system. In the center of the vehicle console 10 is a push button for switching on the hazard warning lights. The conventional vehicle console 10 shown in FIG. 1 has a large number of control buttons, switches and knobs. The large number of controls reduces user friendliness for the average user who may use only a portion of the available controls.

Figure 2:
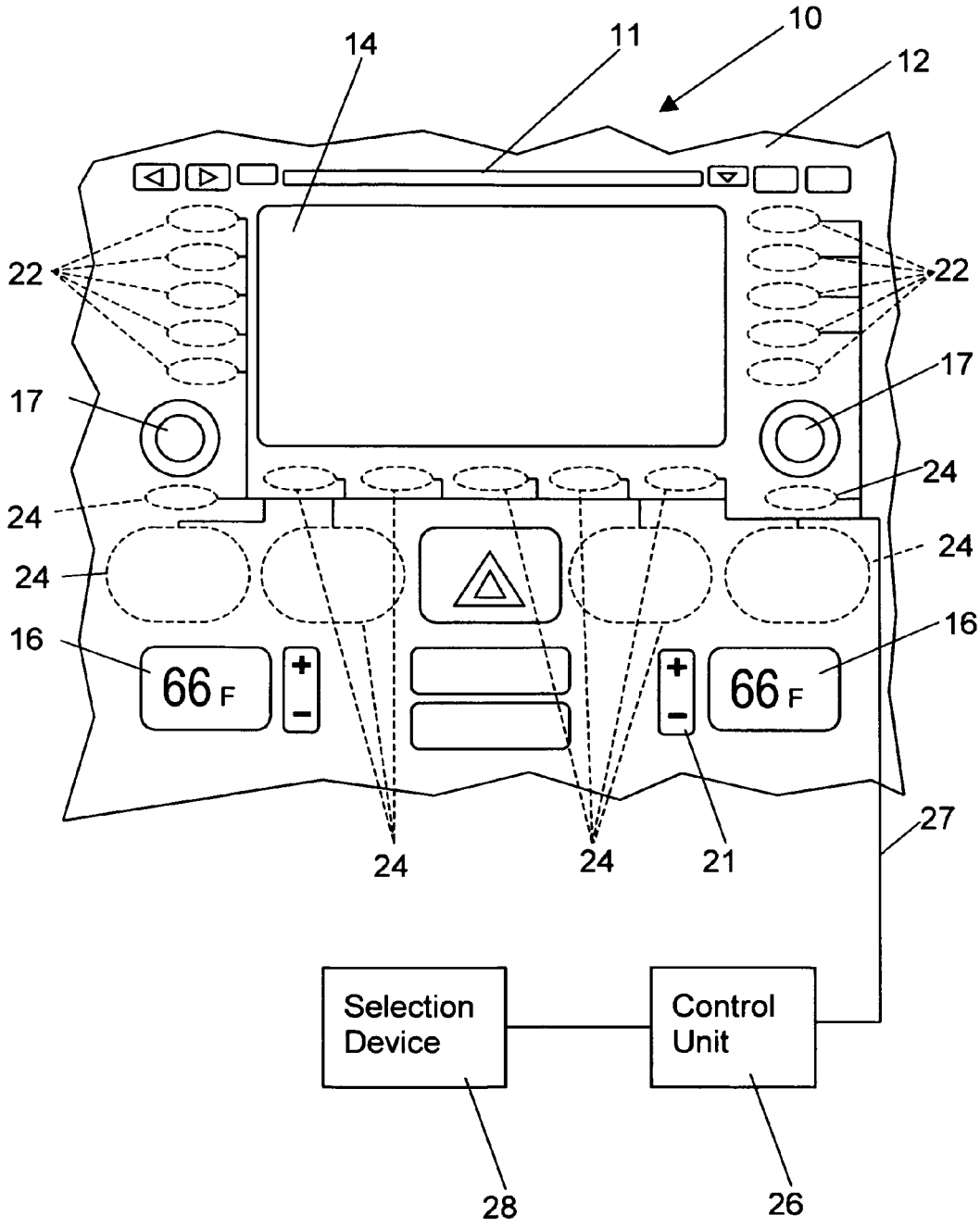
FIG. 2 is a diagrammatic plan view of a vehicle console with a console interface in accordance with the invention.

FIG. 2 is a diagrammatic plan view of a vehicle console 10 having a console interface 12 in accordance with the invention. The console interface 12 includes a large center display 14 and two smaller liquid crystal displays 16. In the embodiment of the vehicle console 10 shown in FIG. 2, some of the selection buttons are permanent selection buttons just like the conventional selection buttons shown in FIG. 1. Advantageously, those selection buttons that are frequently used, such as the basic functions of the stereo system and the basic functions of the climate control system, are embodied as permanent selection buttons. In contrast to the conventional console interface 12 shown in FIG. 1, the console interface 12 according to the invention has reconfigurable, shape-changing buttons that replace most of the rigid, protruding selection buttons of the conventional console interface. The selection buttons 22, 24 are embodied as reconfigurable buttons that can be controlled such that the buttons can change their shape from a protruding, for example hemispherical, shape to a flat shape. The location of these shape-changing buttons on the vehicle console 10 is indicated by dashed lines. In the exemplary embodiment shown in FIG. 2, five reconfigurable, shape-changing buttons 22 are provided along the left side of the display 14 and another five shape-changing buttons 22 are provided along the right side of the display 14. Further shape-changing buttons 24 are provided along the bottom of the center display 14.

The shape-changing buttons 22, 24 are connected via connecting lines 27 to a control unit 26. The control unit 26 selectively activates and deactivates the shape-changing buttons 22, 24. A selection device 28 is connected to the control unit 26. The selection device 28 allows a user to select among a number of operating modes of the vehicle console. For example, the user may select an operating mode that activates the audio control buttons or the navigation control buttons. The selection device 28 may for example be a knob or scroll wheel that allows the user to scroll through the various operating modes of the vehicle console 10.

As can be seen when comparing FIGS. 1 and 2, the shape-changing buttons allow modifying existing vehicle consoles 10 or button consoles such that the complexity of these consoles is reduced by replacing conventional rigid, protruding buttons with shape-changing buttons according to the invention. By replacing conventional buttons with shape-changing buttons, the control interface according to the invention not only simplifies the operation of the control interface but also provides a less cluttered look that is more elegant and aesthetically pleasing. Another advantage of the shape-changing buttons according to the invention over touch screens is that the tactile feel of a traditional button is preserved.

Shape-changing buttons 22, 24 according to the invention can be devised in various ways.

Figure 3:
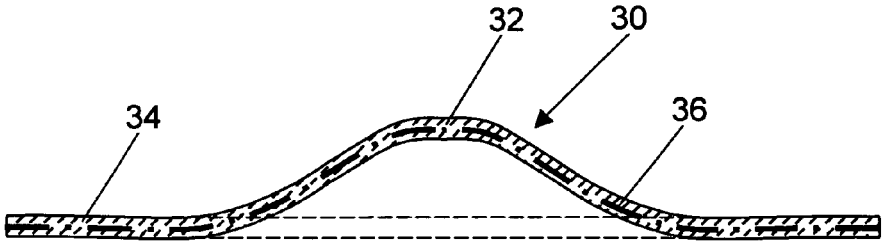
FIG. 3 is a diagrammatic sectional view of an embodiment of a shape-changing button according to the invention.

FIG. 3 is a diagrammatic sectional view illustrating two alternative button states of the shape-changing button 30 according to the invention. In a first state, the active state, the shape-changing button 30 is dome-shaped and operates as a push button. The dome 32 protrudes beyond the console surface 34 and provides the tactile feel of a traditional button. In a second state, the shape-changing button 30 is essentially flat and level with the console surface 34 so that the button 30 seems to disappear. The second state of the button is indicated by dashed lines in FIG. 3. When the shape-changing button 30 is in the first state and protrudes from the console surface 34, then the button 30 operates as a push button and performs the switching operation of a traditional button when the button 30 is pressed. When the shape-changing button 30 is in the second state, the button 30 is inoperative and does not perform a switching operation. The shape-changing properties of the button 30 can be achieved by embedding for example a shape memory alloy wire mesh or a shape memory alloy thin film into a flexible material. The embedded alloy wire mesh or alloy thin film is schematically indicated by a dash-dotted line 36. Alternatively, the shape changing properties can be achieved by forming the button from a shape memory polymer. The shape-changing properties can further be achieved with a compliant mechanism.

Figure 4:
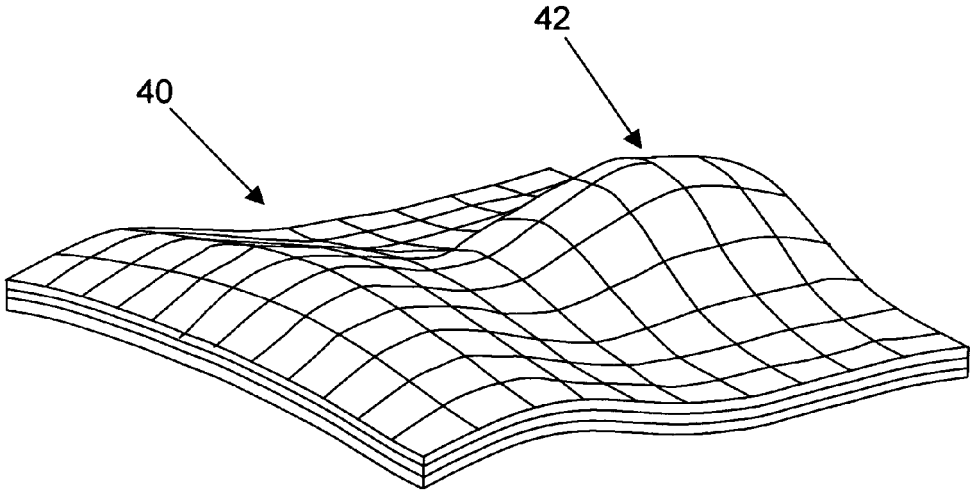
FIG. 4 is a diagrammatic perspective view of a morphable surface forming a shape-changing button according to the invention.

FIG. 4 is a diagrammatic perspective view of a morphable surface 40 that forms a shape-changing button according to the invention. The morphable surface 40 has two stable states. In the first state or active state, the morphable surface 40 has a protrusion 42 which forms a button 42. The button or protrusion 42 can be pressed like a traditional push button. The protrusion 42 of the morphable surface 40 corresponds to the dome 32 shown in FIG. 3. In the second state or inactive state, the morphable surface 40 would be substantially flat. The protrusion 42 and thus the button would disappear.

Figure 5:
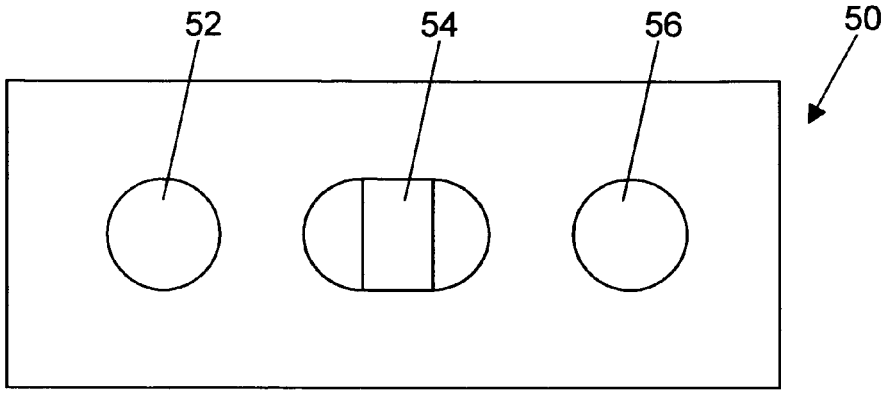
FIG. 5 is a diagrammatic top plan view of a further exemplary embodiment of a button configuration including shape-changing buttons according to the invention.

FIG. 5 is a diagrammatic top plan view of a further exemplary embodiment of a button configuration 50 including shape-changing buttons 52, 54, 56. The two circular buttons 52, 56 may have a diameter of for example 13 mm and the elongated button 54 that is positioned between the two circular buttons 52, 56 may have a length of for example 23 mm. The spacing distance between the buttons 52, 54, 56 may for example be 15 mm. The button configuration 50 shown in FIG. 5 may constitute a portion of a vehicle console, a dashboard, or other vehicle interior panel or may also constitute a portion of a steering wheel.

Figure 6:
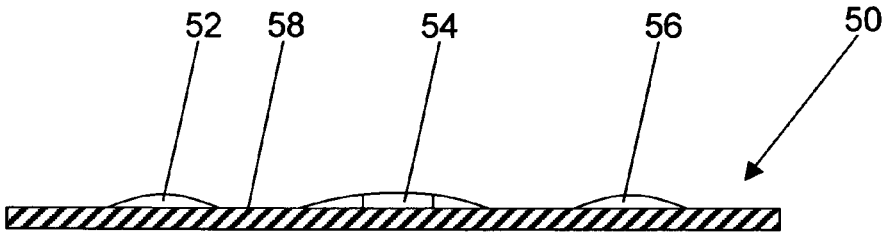
FIG. 6 is a diagrammatic side view of the button configuration shown in FIG. 5.
Figure 7:
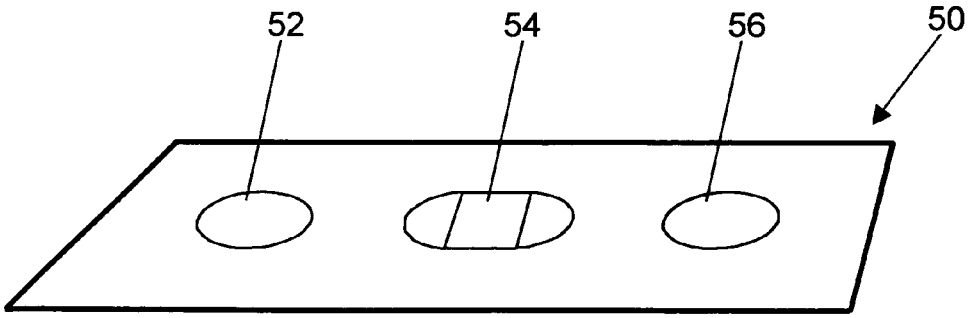
FIG. 7 is a diagrammatic perspective view of the button configuration shown in FIGS. 5 and 6.

FIG. 6 is a diagrammatic side view of the button configuration 50 shown in FIG. 5. The buttons 52, 54, 56 are configured such that they protrude for example 3 mm from the surface 58. The buttons 52, 54, 56 are shown in their active state, i.e. the buttons protrude beyond the surface 58 and operate as push buttons. In the inactive state, the buttons 52, 54, 56 change their shape such that the surface 58 of the button configuration 50 is substantially flat without any protrusions in the region where the buttons are located. FIG. 7 is a diagrammatic perspective view of the button configuration shown in FIGS. 5 and 6.

A button console using buttons as shown in FIGS. 5 to 7 preferably has the following features. An array of buttons may include primarily hemispherical buttons with a base circle diameter of about 15 mm and a height of about 3 mm. Other button shapes such as triangles, squares and ovals could be produced in the same manner as round buttons. All buttons have two states as described above, in one state, the buttons would form a flat surface that is level with the surrounding console. In the other state, the button would have a hemispherical shape or some other protruding shape as a final button shape. The buttons are stable in both states and there is no power consumption except when switching between the two states.

Each of the shape-changing buttons can be activated individually. Alternatively, groups of buttons can be activated in accordance with their functionality. For example, a set of buttons dedicated to audio functions could be activated together.

The activation of the shape-changing buttons could be performed through the use of a voice control, a central click knob or scroll wheel close to or on the steering wheel to scroll through the various modes for the button console, through a thermal resistive stimulus, or external thermal stimuli.

A preferred embodiment allows the user to scroll through a number of modes for the console that has the shape-changing buttons. The user may for example select the following modes: (a) All buttons off, (b) Audio control buttons on, (c) Radio/music/video control buttons on, (d) Navigation buttons on, (e) Car climate control buttons on, (f) Driver assistance, such as cruise control related functions, on, (g) Infotainment functions on, (h) All buttons on.

When a shape-changing button is switched on, i.e. activated, the button is advantageously configured to be usable with an audible click sound when pressed. In the active state, the shape-changing buttons according to the invention perform like regular buttons in cars, e.g. a 'volume up button' when pressed turns up the volume. Further, in case of a lack of space for a large button console, a small array of shape-changing buttons may be provided, each button having various functions depending on the mode it is being used in.

The texture and feel of the shape-changing buttons is advantageously selected such that the buttons are hard enough to not sag when pressed, and soft enough to be pressable and perform the function of a push button. The outer material or covering layer for the shape-changing buttons is generally a flexible material such as a rubber material, silicone or similar materials that are also used for conventional buttons.

Embodiments of shape-changing buttons that require energy for switching from one stable state to another stable state are advantageously connected to the battery supply voltage of the vehicle. The response time of the shape-changing buttons, i.e. the time necessary to go from a flat surface to the final hemispherical shape or other protruding shape would be about one second with a similar time for the return path to the flat state.

Figure 8:
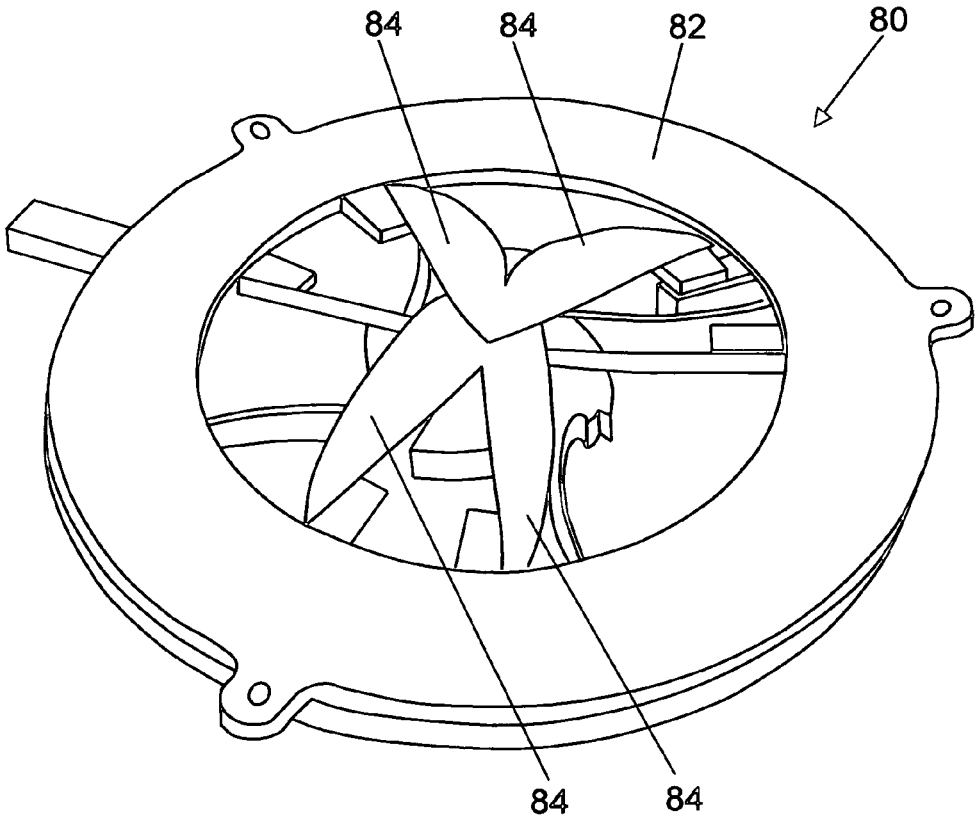
FIG. 8 is a diagrammatic perspective view of a prototype of a conceptual embodiment of a morphable structure to be used for a shape-changing button according to the invention.

FIG. 8 is a diagrammatic perspective view of a prototype of a conceptual embodiment of a morphable structure 80 to be used for a shape-changing button according to the invention. The morphable structure 80 uses a compliant mechanism. The structure 80 has a circular support structure 82. Supported on the circular support structure 82 are four elongated leafs 84. The four elongated leafs 84 are configured such that they have two stable states. The bistability of the compliant mechanism is preferably assured by a latching mechanism that latches the compliant mechanism in a respective on of the stable states. In a first state, the four elongated leafs 84 extend from the circular support structure 82 inwards and upward in order to form a dome-shaped structure. In order to form a shape-changing button that has a smooth, homogeneous surface structure, the morphable structure 80 could be covered with a covering layer 86 as is schematically indicated by a dashed line in FIG. 9. In a second state, the four elongated leafs 84 would extend from the circular support structure 82 inwards toward the center such that the four elongated leafs 84 are substantially level with the circular support structure. When covered with a covering layer, the morphable structure 80 would result in a flat surface when in the second state.

Figure 9:
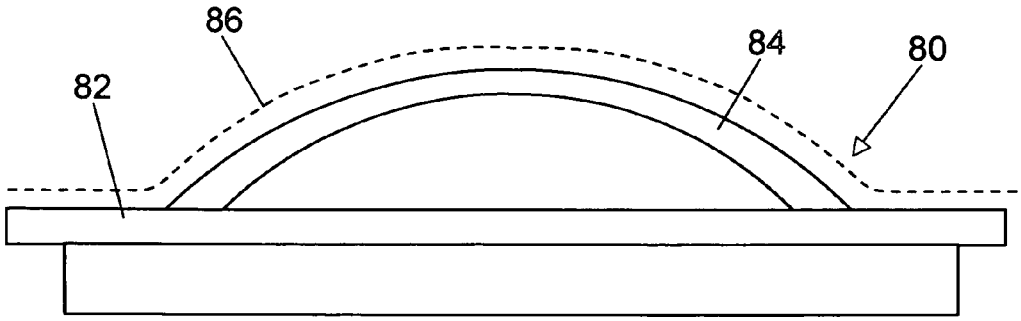
FIG. 9 is a diagrammatic side view of the morphable structure shown in FIG. 8.

FIG. 9 is a diagrammatic side view of the morphable structure 80 shown in FIG. 8. The four elongated leafs 84 are supported on the circular support structure 82 and extend inward towards a center where they meet. FIG. 9 shows the first state of the morphable structure 80. The four elongated leafs 84 extend upward and form a dome-shaped structure that serves as a push button. The morphable structure 80 is covered with a covering layer 86 which is only schematically indicated by a dashed line 86. If the morphable structure 80 were integrated into a vehicle console, the covering layer 86 would form the surface of the console. When in the second state, the four elongated leafs 84 would extend substantially level with the circular support structure 82. The covering layer 86 would then provide a flat surface as if there were no button in that location of the console.

Shape-changing buttons according to the invention can be devised in various ways and may for example be based on a three-dimensional shape morphing via compliant mechanisms such as the mechanism shown in FIGS. 8 and 9. Such mechanisms are typically single-piece flexible structures where the structure can deform in three dimensions and transmit force or deliver motion due to an input actuation. In this case, the transformation is from a flat surface to a uniformly hemispherical or dome-shaped surface resembling a button as explained above with reference to FIGS. 3 to 9. Since there are no joints in such mechanisms, assembly time is reduced or entirely eliminated. A further advantage is that there is no wear or backlash, and the compliant mechanism is inexpensive and easy to maintain. Its synthesis involves the use of structural optimization algorithms with the right selection and combination of rigid and flexible materials to effect the desired solution. The flexibility or compliance is uniformly distributed throughout the structure thus providing a smooth transition to a dome from a flat surface. Bistability, i.e. having two stable states, can be inherently incorporated in the compliant mechanism structure and thus, power would only be required to switch between the two button states, making the compliant mechanism extremely efficient. Compliant mechanisms also provide a scalable solution from small to large buttons.

As already mentioned above, the shape-changing buttons may also be made from shape memory polymers. When subjected to thermal stimuli, these shape changing polymers can exhibit a radical change from a rigid polymer to a very elastic state, then back to a rigid state again. In its elastic state, it will recover its memory shape if left unrestrained. For example, it will recover to a dome-shaped structure as shown in FIG. 3. While manipulated, the shape memory polymer (SMP) can be cooled and therefore returned to a rigid state, maintaining its manipulated shape indefinitely. The device therefore inherently exhibits bistability and can easily transition between a flat surface and a dome shaped structure. The temperature for the transition can be controlled depending on the constituents and the manufacturing process for the shape memory polymer (SMP) that is used. A transition between the stable states can be performed in a matter of seconds. The heating and/or cooling of the shape memory polymer is preferably performed by an internal heating mechanism in the SMP in order to reduce the size of the system.

Another possibility to provide shape-changing buttons includes the use of a shape memory alloy wire mesh. In particular, a composite of a flexible material and a shape memory alloy wire mesh is used. Shape memory alloy wires, such as a NiTi alloy wires, can deform to a so-called memory shape extremely rapidly upon heating to a controllable transformation temperature. A reverse bias mechanism can be used to take the wire mesh from the dome-shape, which is the memory shape, back to the flat state or "buttonless" state. Heat can be resistively applied through the conductive alloy wires. By forming a mesh of NiTi wires and embedding the mesh within a flexible material, such as silicone, button-like structures can be easily formed with the right texture. The shape memory alloy wire mesh provides the required bistability for the shape-changing button.

A further possibility to provide shape-changing buttons includes the use of a sandwich structure formed of a shape memory alloy thin film and a flexible material. In this case, the shape memory alloy thin film could be embedded in the flexible material or the shape memory alloy thin film could be attached to a layer of flexible material.

NiTi thin films when heated beyond their transformation temperature and constrained exhibit enormous stresses which can be used to transmit force and motion. By embedding the NiTi thin film in a flexible material such as silicone and providing given constraints, a shape-changing structure with two stable states is provided, i.e. a dome-shape and a flat surface is provided.

The above-described embodiments of shape-changing buttons and consoles using such buttons are only exemplary and further embodiments are within the scope of the invention.

We claim:

1. A button configuration comprising:

a vehicle console having a console surface;

a user-operable push button having a central region and a peripheral region, said peripheral region encircling said central region and defining a surface plane;

said central region of said user-operable push button and said peripheral region of said user-operable push button forming said console surface;

said user-operable push button having an active state and an inactive state;

said central region of said user-operable push button protruding from the surface plane such that said console surface forms a protrusion on said vehicle console when said user-operable push button is in the active state and said protrusion on said vehicle console provides a push button function; and said central region of said user-operable push button extending substantially in said surface plane and providing no push button function when said user-operable push button is in the inactive state such that said console surface forms a substantially flat surface when said user-operable push button is in the inactive state.

2. The button configuration according to claim 1, wherein a continuous layer of a shape memory polymer forms said central region and said peripheral region of said user-operable push button.

3. The button configuration according to claim 1, wherein at least said central region of said user-operable push button includes a compliant mechanism having two stable states such that said central region of said user-operable push button forms a protrusion on the surface plane defined by said peripheral region when said user-operable push button is in the active state and said central region of said user-operable push button is substantially flat and level with said peripheral region of said user-operable push button when said user-operable push button is in the inactive state.

4. The button configuration according to claim 1, wherein:

at least said central portion of said user-operable push button includes a shape memory material;

said shape memory material exhibits a bistability such that said shape memory material forms a protrusion on said surface plane when said user-operable push button is in the active state; and said shape memory material forms a substantially flat layer extending in the surface plane when said user-operable push button is in the inactive state.

5. The button configuration according to claim 4, wherein said shape memory material is a material selected from the group consisting of a shape memory polymer and a shape memory alloy.

6. The button configuration according to claim 4, wherein:

said shape memory material is a shape memory alloy thin film; and a flexible material and said shape memory alloy thin film form a sandwich structure.

7. The button configuration according to claim 4, wherein:

said shape memory material is a shape memory alloy wire mesh; and said shape memory alloy wire mesh is embedded in a flexible material.

8. The button configuration according to claim 7, wherein:

said shape memory alloy wire mesh has an ohmic resistance and is configured to be heated with an electric current flowing through said shape memory alloy wire mesh; and said shape memory alloy wire mesh has a memory shape and deforms into the memory shape when heated to a given transformation temperature.

9. The button configuration according to claim 4, wherein said shape memory material is a shape memory polymer having a memory shape and said shape memory polymer deforms into the memory shape when heated to a given transformation temperature.

10. The button configuration according to claim 9, including an internal heating mechanism integrated with said shape memory polymer.

11. A vehicle control panel configuration, comprising:

a control panel including a user-operable push button, said control panel having a control panel surface;

said user-operable push button having a central region and a peripheral region, said peripheral region encircling said central region and defining a surface plane;

said central region of said user-operable push button and said peripheral region of said user-operable push button forming said control panel surface;

said user-operable push button having an active state and an inactive state;

said central region of said user-operable push button protruding from the surface plane such that said control panel surface forms a protrusion on said control panel when said user-operable push button is in the active state and said protrusion on said control panel provides a push button function; and said central region of said user-operable push button extending substantially in said surface plane and providing no push button function when said user-operable push button is in the inactive state such that said control panel surface forms a substantially flat surface when said user-operable push button is in the inactive state.

12. The vehicle control panel configuration according to claim 11, wherein said control panel is provided on a vehicle interior component selected from the group consisting of a vehicle console, a door panel, a steering wheel and a dashboard.

13. The vehicle control panel configuration according to claim 11, including:

a display disposed adjacent to said user-operable push button; and said display indicating a function of said user-operable push button when said user-operable push button is in the active state.

14. The vehicle control panel configuration according to claim 11, including:

a control unit operatively connected to said user-operable push button for selectively activating and deactivating said user-operable push button.

15. The vehicle control panel configuration according to claim 14, wherein said control unit is configured to activate said user-operable push button via a voice control.

16. The vehicle control panel configuration according to claim 14, wherein:

said control panel includes further user-operable push buttons having an active state and an inactive state; and said control panel is configured to operate in a plurality of operating modes wherein a respective subset of said user-operable push buttons is activated when said control panel is in a respective one of the operating modes; and a selection device is connected to said control unit for selecting the operating modes.

17. The vehicle control panel configuration according to claim 14, wherein:

said control panel includes further user-operable push buttons operatively connected to said control unit; and said control unit selectively activates and deactivates said user-operable push buttons for controlling an electronic vehicle subsystem.

18. The vehicle control panel configuration according to claim 17, wherein said user-operable push buttons are configured to control an electronic vehicle subsystem selected from the group consisting of an audio system, a navigation system, a climate control system and a communications system.

* * * * *